US005364656A

United States Patent [19]

Koorey

[11] Patent Number: 5,364,656

[45] Date of Patent: Nov. 15, 1994

[54] METHOD FOR REFINISHING VEHICLE WHEELS

[76] Inventor: Daniel P. Koorey, 31337 Walker Rd., Bay Village, Ohio 44140

[21] Appl. No.: 122,862

[22] Filed: Sep. 15, 1993

[51] Int. Cl.[5] ..... B05D 1/00

[52] U.S. Cl. ..... 427/142; 427/327; 118/300; 118/504

[58] Field of Search ..... 427/142, 327, 532; 51/281 R, 283 R; 118/504, 500

[56] References Cited

U.S. PATENT DOCUMENTS

| | | | |
|---|---|---|---|
| 2,081,666 | 5/1937 | Gunn | 91/65 |
| 2,835,222 | 5/1958 | Hall | 118/505 |
| 3,007,401 | 11/1961 | Kordenbrock | 101/127 |
| 4,628,858 | 12/1986 | King et al. | 113/504 |
| 4,763,392 | 8/1988 | Fogal et al. | 29/159.1 |
| 4,950,505 | 8/1990 | Fogal | 427/327 |
| 5,244,506 | 10/1993 | Enegren | 427/327 |

*Primary Examiner*—Shrive Beck

*Assistant Examiner*—Brian K. Talbot

*Attorney, Agent, or Firm*—Ralph E. Jocke

[57] ABSTRACT

A method for refinishing vehicle wheels includes removing the wheels with the tires thereon from the vehicle. The locations of the wheel weights are then marked on the tire and the weights are removed. The wheel and tire are then placed in a blast cabinet and the existing coatings on a face surface of the wheel are removed using a plastic blast media. Thereafter corrosion of the metal of the face surface is removed by blasting with rigid glass blast media. The tire is removed from the cabinet and any excess media is removed with an air blast. The tire is masked to prevent overspray. Thereafter the wheel is coated with one or more layers of coating. The coated wheel is then heated to facilitate curing, and the wheel weights are reinstailed prior to the coating being fully cured. The method of the present invention is particularly well-adapted for performance in a mobile service vehicle that can travel to the vehicle whose wheels are to be refinished.

20 Claims, 4 Drawing Sheets

METHOD FOR REFINISHING VEHICLE WHEELS

TECHNICAL FIELD

This invention relates to wheels for vehicles. Specifically, this invention relates to a method for refinishing decorative wheels that is preferably accomplished with the tires installed and at the site of the vehicle.

BACKGROUND ART

Decorative wheels are very popular on cars and trucks. Decorative wheels eliminate the need for hubcaps and look better than wheels that have hubcaps installed over conventional steel wheels. Many types of decorative wheels reduce vehicle weight by eliminating the hubcap and by being made of aluminum or other light alloys. Alloy wheels also provide better vehicle performance than conventional wheels.

The appearance of decorative wheels often deteriorates. There are several reasons for this. Such wheels are usually coated with a clear coating which may become marred or scratched. Corrosion may occur and damage the appearance of the wheels. Corrosion occurs when the coating is broken and the metal is exposed to water and air. Corrosion is particularly a problem in colder climates where road salt is used. The moisture and salt greatly accelerates the corrosion.

The application of wheel weights to balance the wheels also creates potential problems. Wheel weights are attached to the wheel by metal fingers that lock into an outer rim. The locking action frequently cracks the coating causing a site for corrosion to start. Once corrosion starts it propagates under the wheel coating, greatly deteriorating the appearance of the wheel. Plastic coated wheel weights have been used to minimize corrosion. However, they are of limited usefulness as the locking action necessary to hold the weight to the wheel still often cracks the coating.

Currently if a wheel is corroded, great time, expense and cost is required to refinish it. The refinishing process involves removing all of the wheels from the vehicle. Usually all four wheels will exhibit corrosion or other deterioration. However, even if only one wheel is bad, all wheels are usually refinished because the owner of the vehicle would want all the wheels to look the same.

The wheel weights and tires are then removed from the wheels by the garage or dealer performing the service. The tires are removed. The wheels are then sent to a machine shop or sandblasting shop.

A sandblasting shop blasts the wheels (usually front and back) to remove all coating and corrosion. The blasting process is normally carried out using a rigid blasting material. If the wheel is highly polished, the blasting process usually dulls the shine.

A machine shop typically removes the coating either chemically or mechanically. The wheels are then turned to remove the corrosion and to expose a from metal surface. The surface is then polished to the desired reflectiveness.

From the machine shop (or the sandblasting shop if high shine was not desired) the wheels are then transported to a paint shop. A paint shop first prepares the wheels by removing any dirt or oil accumulated during prior processing or which was picked up in transit. The wheels are then coated with an appropriate coating. Usually this involves application of a clear coat, however in some cases a color coat may be applied underneath the clear coat. Certain wheels also have multiple color schemes or matte areas. In such cases, masking and painting of the desired colors is required and then a final top coating of clear material is applied. Once the coatings are fully cured the wheels are shipped back to the garage or dealer who has the car.

The garage or dealer remounts the tires on the wheels. Because the tires would be moved from their original positions, the tires and wheels must be rebalanced and new wheel weights installed in the locations dictated by the balancing procedure. Finally, the wheels and tires are returned to the car and the vehicle is ready for the road.

Because this prior art process involves several entities it can often result in the car being tied up for more than a week. This is not generally acceptable. Further, because installing the tires on the wheels involves using tools to stretch the beads of the tires, damage to the new coating on the wheels often occurs. This causes scratches that are sites for new corrosion to start as soon as the wheel is exposed to moisture. Also, because the coatings were fully cured at the time that the new wheel weights were installed, such installation often cracks the coating forming further sites for corrosion to begin.

A substantial drawback of the prior art approach to refinishing wheels is the cost. With so many process steps and shipping costs, refinishing all but the most valuable decorative wheels is cost prohibitive.

Thus, there exists a need for a method for refinishing wheels that is faster, less expensive and reduces further corrosion of the wheels once the process is complete.

DISCLOSURE OF INVENTION

It is an object of the present invention to provide a method for refinishing vehicle wheels that can be accomplished rapidly.

It is a further object of the present invention to provide a method for refinishing vehicle wheels that reduces future corrosion.

It is a further object of the present invention to provide a method for refinishing vehicle wheels that can be accomplished with the tires mounted on the wheels.

It is a further object of the present invention to provide a method for refinishing vehicle wheels that can be done at the site of the vehicle.

It is a further object of the present invention to provide a method for refinishing vehicle wheels that is lower in cost.

It is a further object of the present invention to provide a method for refinishing vehicle wheels that provides for selectively removing corrosion from areas of the wheel.

It is a further object of the present invention to provide a method for refinishing vehicle wheels that can be performed in a mobile self contained service vehicle.

Further objects of the present invention will be made apparent in the following Best Modes for Carrying Out Invention and the appended claims.

The foregoing objects are accomplished in the preferred embodiment of the present invention by a method for refinishing vehicle wheels that is carried out at the site of the vehicle in a mobile service truck. The wheels and tires of the vehicle are removed. If the wheels are wet because of rain or snow, they are dried to a damp condition with a heat gun or other suitable drying means.

The wheel weight locations on the outside face surface of the wheel are marked on the tire adjacent to the wheel. The markings are made so that the wheel weights may be later installed in their original locations. The wheel weights are then removed.

The wheel and tire are then placed in a blast cabinet in upright condition. The face of the wheel is first blasted with a plastic abrasive blast media which serves to remove the existing coating material from the face of the wheel. While in the blast cabinet, the wheel is rotated in an upright condition on rollers which facilitates removal of the coating.

The face of the wheel is then selectively blasted with a glass bead media to remove corrosion therefrom. The blasting with the glass bead media is selectively done to remove corrosion in the locations where it is found. The wheel is also rotated within the cabinet in the upright condition to facilitate blasting process. After blasting with the glass media the wheel is removed from the blast cabinet. The wheel is then blasted with an air blast to remove any residual blasting media on the surface of the wheel.

The valve stem and tire adjacent the wheel are then masked to prevent overspray from attaching thereto. The wheel is coated with a suitable spray coating. The coating may include a layer of pigmented coating followed by a layer of clear coating or may include only a clear coating as desired. After application of the coating, the masking is removed.

The newly coated wheel is heated by exposure to quartz halogen heat lamps to accelerate curing.

After the coating has cured to the extent that it is dry to the touch, the wheel weights are reinstailed according to the markings on the tire. As the coating has not fully cured at this point and is flexible, installation of the wheel weights does not crack or cut the coating.

The wheels are then installed on the vehicle to complete the method. The entire process for a group of four wheels is accomplished quickly usually taking less than four hours rather than several days as was the case with the prior art. This enables the vehicle to have its wheels refinished in conjunction with routine servicing and does not deny the owner the use of the car for an extended period of time.

BEST MODES FOR CARRYING OUT INVENTION

Figure 1:
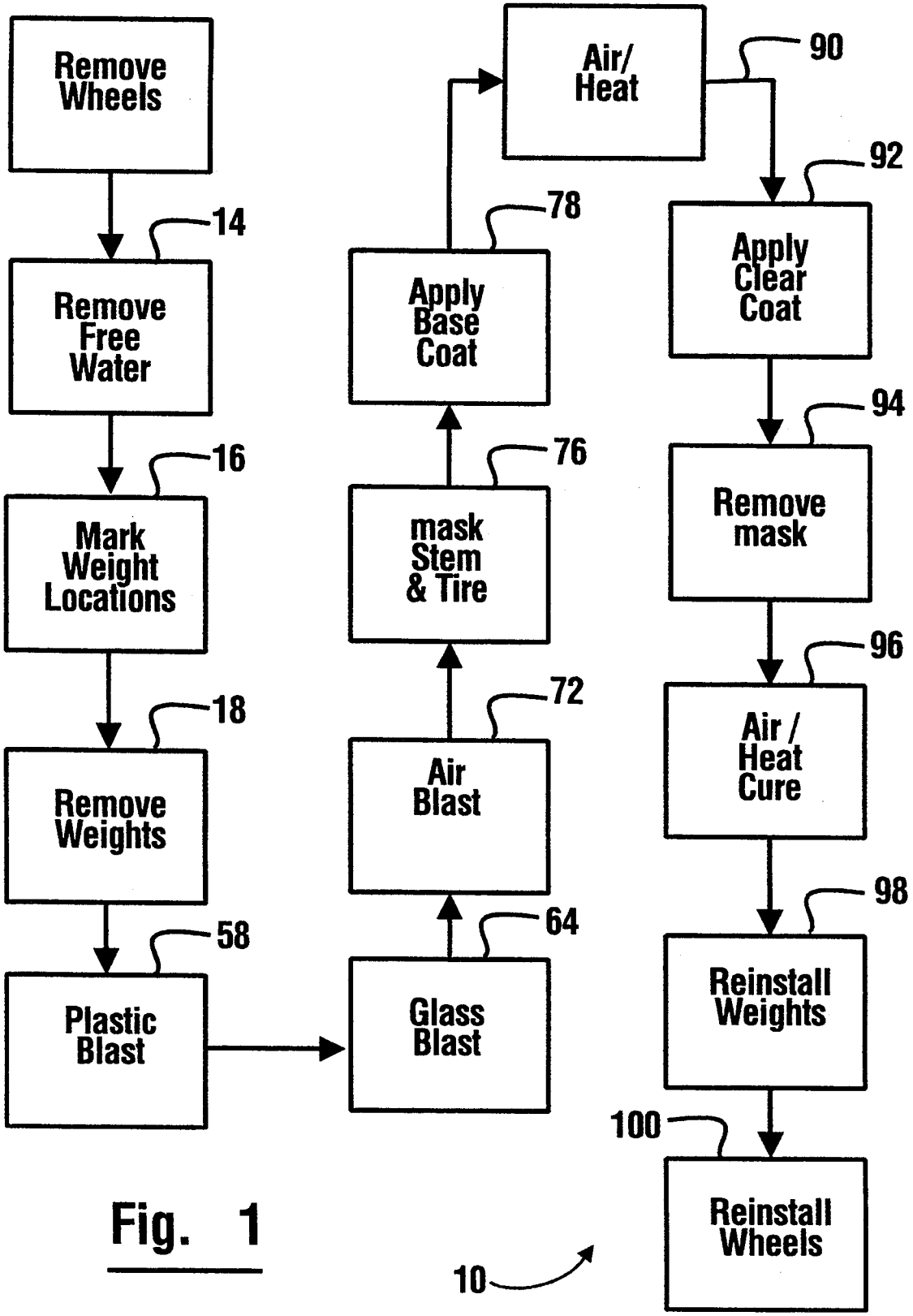
FIG. 1 is a flow chart of the method steps of the method for refinishing vehicle wheels of the preferred embodiment of the present invention.

Referring now to the drawings and particularly to FIG. 1, there is shown therein a flow chart 10 of the method steps of the preferred embodiment of the present invention. The method begins with a step 12 of removing the wheels and tires from the vehicle. Usually all four vehicle wheels are removed with the car up on a lift. It is usually desirable to refinish all the wheels so that they match perfectly although any lesser number of the wheels may be refinished as desired.

If it is raining or snowing when the method is to be carried out, it is desirable to remove any free water from the wheels at a step 14. If the wheels are not wet, this step is eliminated. Water removal is preferably done by directing hot air from a heat gun at the wheel. Applicant has found that a Wagner No. 0283015 heat gun is suitable for this purpose.

The next step 15 is to mark the locations of the wheel weights. Because the wheels are usually well-balanced at the time the method is to be carried out, and rebalancing involves both time and expense, there is usually no need to rebalance the wheels after the method is complete. The wheel weight locations on the outer face of each wheel are marked on the tire in locations slightly away from the outer rim. This is done using a grease pen. The markings are made in a manner that will enable the weights to be reinstalled at their proper locations. This usually entails marking the center locations of the weight and the number of ounces. The weights on the interior face of the wheel need not be removed as the interior face is generally not refinished.

Once the wheel weight locations have been marked, the wheel weights are removed at a step 18. The weights are then set aside for further use. Usually such weights are of the plastic-coated type, and are suitable for reuse. However, if uncoated weights are encountered, a supply of new weights is maintained available for later installation.

The method of the present invention is preferably carried out in a mobile self-contained service vehicle. This enables the method to be carried out at the garage or dealership where the vehicle is located.

Figure 2:
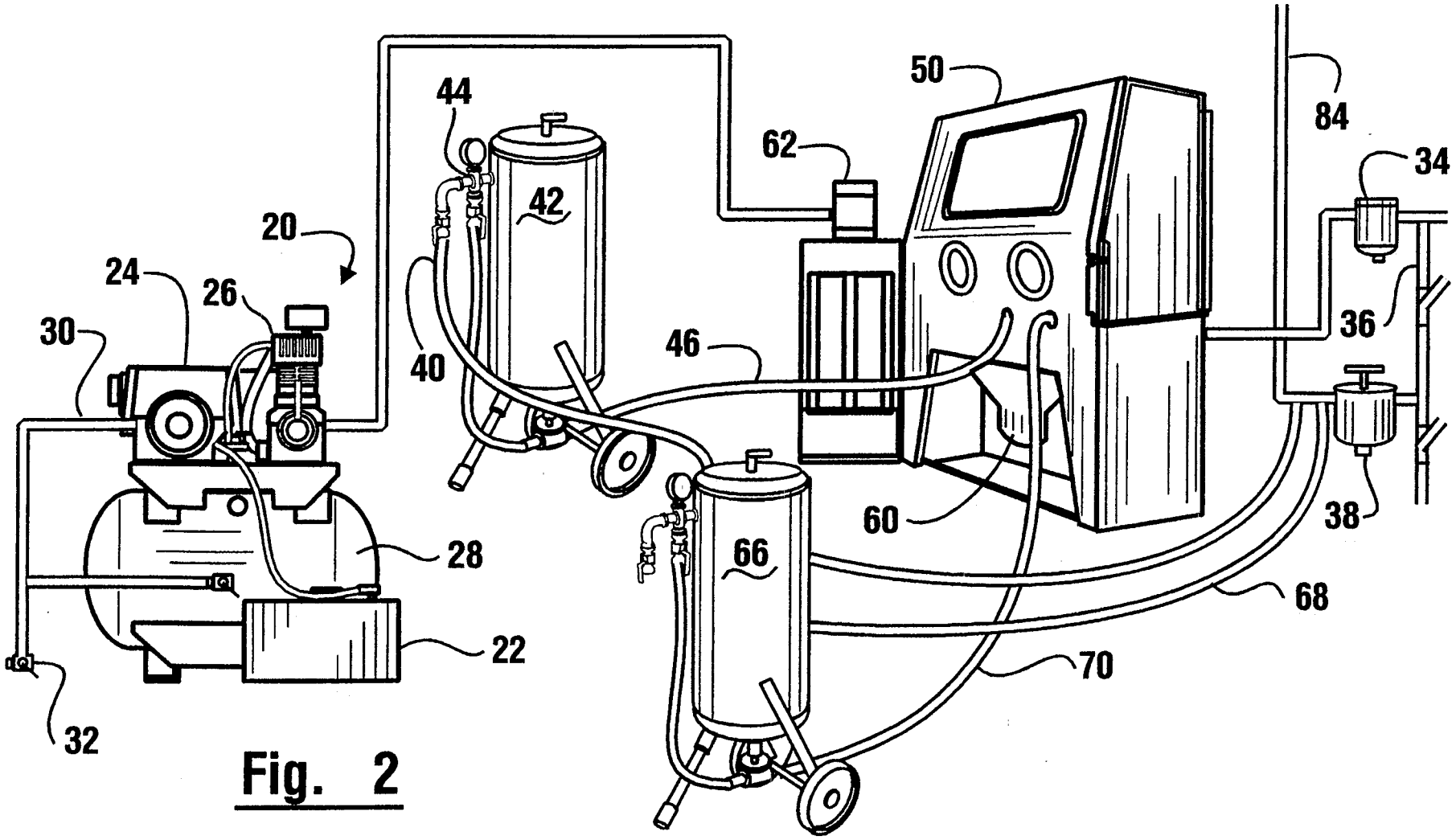
FIG. 2 is a perspective view of some of the coating and corrosion removal equipment used in performing the method.
Figure 3:
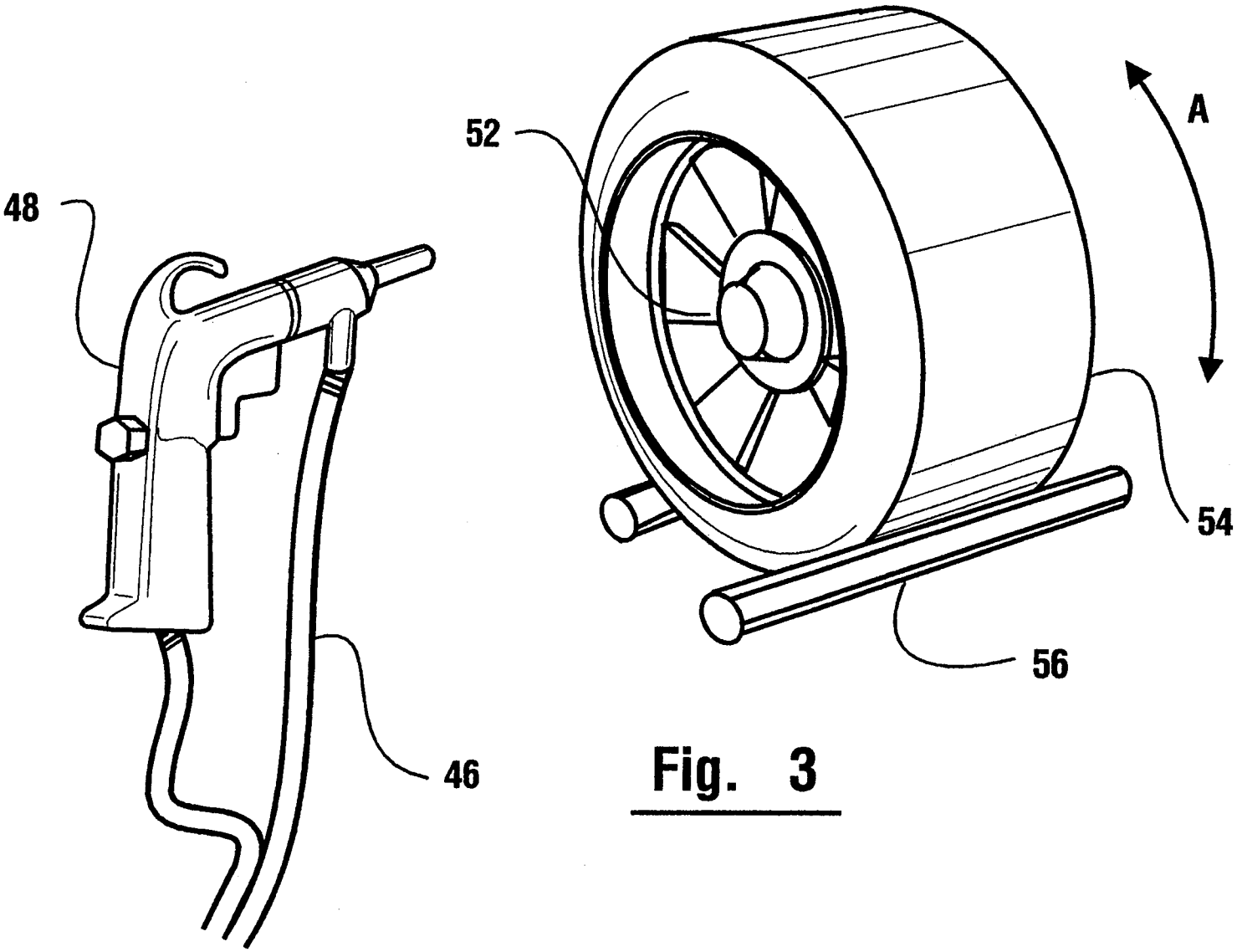
FIG. 3 is a perspective view of a vehicle wheel undergoing treatment with blast media.
Figure 4:
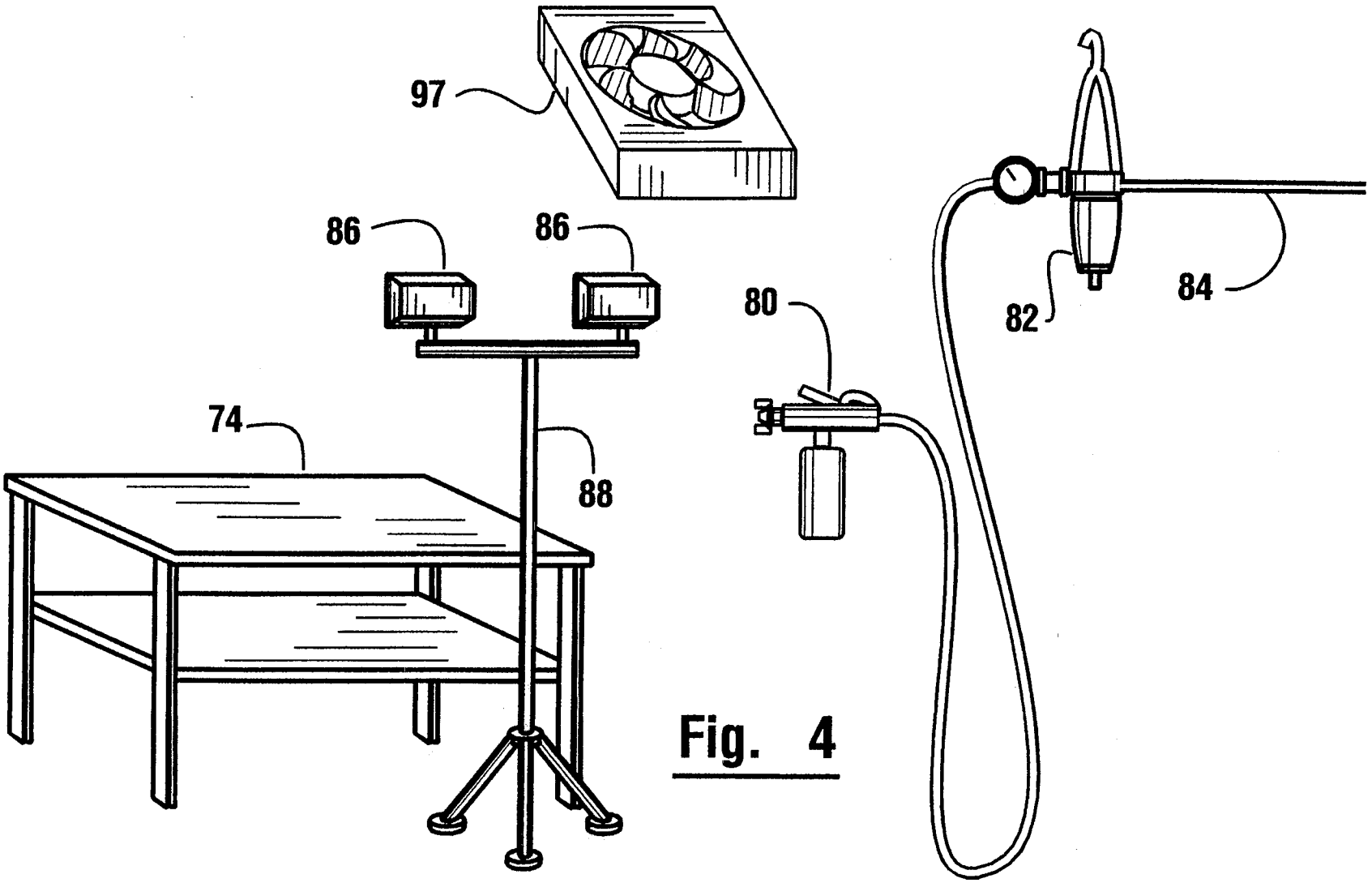
FIG. 4 is a perspective view of some of the coating application and curing equipment used in performing the method.

Some of the equipment used for carrying out the method of the present invention in a mobile wheel refinishing service vehicle is shown in FIGS. 2 through 4. Some of the equipment includes a gasoline powered air compressor 20. Air compressor 20 has a large fuel tank 22 which feeds a motor section 24. The motor section drives a compressor section 26 which compresses the air which is accumulated in a tank portion. The compressor 20 is fixed to the bed of the service vehicle as shown. The compressor is operated in the conventional manner with a relief valve on the tank portion so that the line pressure is maintained within safe limits.

Compressed air from the tank portion 28 is delivered through an air line 30. Air line 30 includes a first trap leg 32 that includes a drain valve. Air line 30 includes various fittings and runs so that it extends for about 25 feet from the trap leg 32. This long run is desirable to reduce the moisture content from the compressed air before it reaches downstream components. Such low-moisture content is important to the successful operation of the equipment.

Air line 30 is further connected to a moisture reducing filter 34 of conventional design. After passing through the moisture-reducing filter 34 the air is passed into a second trap leg 36. Air then passes through a coalescing filter 38 which serves to further remove water and impurities.

After passing through the coalescing air filter, air is delivered through a line 40 to a first blast unit 42. Blast unit 42 is adapted for holding a plastic abrasive blast media. The blast unit 42 has an air filter/regulator 44 mounted thereon. A hose line 46 delivers air and blast media to a sand blast gun 48 (see FIG. 3) which is located inside a blast cabinet 50.

As shown in FIG. 3, a wheel 52 that is to undergo refinishing in accordance with the method of the present invention, has a tire 54 mounted thereon. The wheel and tire assembly is positioned inside blast cabinet 50. The wheel is preferably held upright on rollers 56 that enable it to be rotated about its normal axis as indicated by arrows A.

A plastic blast media is delivered from gun 48. The plastic blast media is directed against the wheel and is operative to remove the coatings from the face surface of the wheel without affecting the metal. During the removal of the coatings, the tire is rotated on rollers 56 to facilitate removal of the coating from the entire wheel circumference. The removal of the coating from the wheel is indicated in FIG. 1 by a step 58.

In the preferred form of the invention, blast unit 42 is a Tip model 70-S and is used in conjunction with a Tip "38 special" trigger operated sandblasting gun. The blast unit 42 is operated using a 30 to 40 mesh plastic bead media, preferably a material sold commercially as "Maxi-blast" 30–40. The blast unit 42 is preferably operated at a pressure of 100 p.s.i.

During blasting with the plastic abrasive media, the media is contained within the cabinet 50 and falls downward into a funnel portion 60. From funnel portion 60 it is directed into a suitable collection bag (not shown). This enables the plastic media to be collected and reused. A dust collector 62 of conventional design is also connected to the cabinet 50 to minimize the escape of dust into the interior of the service vehicle.

After the coating is removed from the wheel, the wheel is then subjected to an abrasive blast using glass bead material. This is indicated in FIG. 1 by a step 64. The blasting with the abrasive glass bead material is accomplished using a blast unit 66 which is identical to blast unit 42 except as specifically described. Blast unit 66 is supplied with air through a hose 68. Like the other blast unit, it is connected to a gun inside cabinet 50 by a hose 70.

In the preferred embodiment of carrying out the method of the invention, blast unit 66 is used with 70 to 100 mesh glass bead material, preferably of a type sold commercially as "Blast-O-Lite" BT-8. The gun used for the glass bead material is a Tip model 99G and is preferably operated with a foot actuator. Blast unit 66 is preferably operated at 90 p.s.i. As with the plastic media, the glass media is collected for reuse and the dust collector is operated during the blast process to minimize the escape of dust.

The glass bead media is used selectively to remove corrosion from the surface of the metal of the wheel. It may also be used to provide a moderately shiny, new surface and to achieve uniformity of appearance across the face of the wheel.

The use of the blast units and guns enables accurate direction of the media to achieve blasting of all the occluded surfaces of the wheel. Further, the striking of the wheel by either the plastic or the glass media does not adversely impact the appearance of the tire.

After blasting with the glass bead material, the wheel is removed from the cabinet and cleaned by blasting with air. This is done to remove any residual blast media and is indicated in FIG. 1 by a method step 72.

After undergoing the air blast at step 72 of the method, the wheel and tire are preferably placed face-surface up on a work bench 74 inside the service vehicle as shown in FIG. 4. The tire is then masked in preparation for coating. This is indicated as a step 76 in FIG. 1.

The masking step involves covering the tire in the area adjacent the wheel. This may be done using masking tape or other suitable masking material. The valve stem which is used to add air to the tire extends through the wheel, and is also preferably masked. This is preferably done using a small, closed, plastic cylinder that fits closely over the stem in slide-on relation. However, the valve stem may also be masked using masking tape.

A new coating is then applied to the wheel. The nature of the coating depends on what is desired. If the wheel is sufficiently shiny, then a layer of clear material is applied. However, usually several coats of material are applied, and this is particularly true if the wheel needs to be painted several different colors.

As shown in FIG. 1, the coating step will often involve the application of a pigmented base coat, shown in FIG. 1 as a step 78. The base coat may be a reflective type pigmented material. In the preferred form of the method of the invention, the preferred base coat is an "Ultra 7000" material made by the Sherwin Williams Company or a material called "Micro-Sequence" which is manufactured by PPG.

The base coat layer is applied using an air spray gun 80. The base coat is usually applied with the wheels sitting flush and face up on bench 74. The air spray gun used is preferably a touch-up gun such as a DeVilbiss Model Number EGHV-530. The spray gun is preferably supplied through a filter/regulator 82 which reduces the input pressure to 50 p.s.i. Filter/regulator 82 is connected to a line 84 which is tapped off from the line feeding the blast units (see FIG. 2).

After application of the base coat, the wheel may be air dried for a short period of time. Alternatively, depending on the material used for the base coat and the temperature conditions, it may be desirable to heat the wheel and tire for a short time. This is done using two 500 watt quartz halogen heating lights 86. The lights are mounted on an adjustable stand 88 that allows them to be directed as desired. Using these lights as a heat source, the preferred base coat will dry almost immediately. Of course, if the temperature is suitably high, the base coat may be dried in air. This short curing step is indicated at 90 in FIG. 1.

After application of the base coat, a layer of clear overcoat material is applied as indicated at step 92. The clear coat is applied using spray gun 80 or a similar gun. In the preferred embodiment of the invention, the clear coat is a polyurethane material such as "Chroma Base" Number 7600S made by DuPont.

After application of the clear coat, the masks are removed as indicated at step 94. The lights 86 are then turned on to apply heat to cure the coating at a step 96. The preferred clear coat material will remain tacky for roughly one-half hour after application. A full cure of the material will occur in approximately four hours in ambient temperature. The total time the material is exposed to the lights depends on the temperature conditions, but one-half hour after application is usually sufficient.

Because of the spray equipment used inside the service vehicle as well as the blasting operations, the interior of the service vehicle is maintained well-ventilated. This is accomplished using a fan unit 97 which is shown schematically in FIG. 4.

After the clear coat is dry to the touch and before being fully cured, the wheel weights are reinstalled on the wheels as indicated at step 98. The weights are reinstailed according to the marks on the tires. As the coating is not fully cured when the wheel weights are reinstailed, the chances for breaking through the coating to the metal of the wheel are reduced. This minimizes the risk of creating a new site for corrosion.

The final step 100 in the method is the reinstallation of the wheels on the vehicle. Once this is done the tires may be cleaned with suitable tire cleaner to remove the marks for the weights as well as to improve their appearance. It is then good practice to check the air pressure in the tires. The vehicle is then ready for the road.

The method of the preferred embodiment of the present invention enables refinishing of even the most intricate wheels in less than one-half day's time. This enables doing the work when the vehicle is in for routine servicing so that the owner is not denied the use of the vehicle.

The method is superior to prior art approaches because the reinstallation of the tires on the wheels is avoided. This not only saves time, but also avoids scratching, which starts the corrosion process all over again.

The preferred embodiment of the method of the present invention is further advantageous because it avoids unnecessary treatment of wheel surfaces. By avoiding treatment of surfaces that are not damaged, it is only necessary to remove the old coating using the plastic material. This minimizes the amount of work required and also helps to maintain the original beauty of the wheel design.

Thus, the method for refinishing vehicle wheels of the present invention achieves the above-stated objectives, eliminates difficulties encountered in the use of prior methods and systems, solves problems and attains the desirable results described herein.

In the foregoing description, certain terms have been used for brevity, clarity and understanding, however, no unnecessary limitations are to be implied therefrom because such terms are for descriptive purposes and are intended to be broadly construed. Moreover, the descriptions and illustrations herein are by way of examples and the invention is not limited to the exact details shown or described.

Having described the features, discoveries and principles of the invention, the manner in which it is constructed and operated, and the advantages and useful results attained, the new and useful structures, devices, elements, arrangements, parts, combinations, systems, equipment, operations, methods and relationships are set forth in the appended claims.

I claim:

1. A method for refinishing vehicle wheels with the tires mounted thereon comprising the steps of:

removing at least one wheel from a vehicle with a tire thereon, said wheel having an exposed decorative face surface extending adjacent said tire;

marking at least one location of a wheel weight positioned adjacent said face surface on the tire with marking means;

removing the wheel weight from the wheel;

removing a coating from said face surface of the wheel by blasting said face surface with a first abrasive media, said tire remaining mounted on said wheel and exposed to said first abrasive media during said coating removal process;

applying new coating material to the face surface of the wheel;

reinstalling the wheel weight in said original location according to the markings; and reinstalling the wheel and attached tire on the vehicle.

2. The method according to claim 1 wherein after removing the coating from the face surface with the first abrasive media and before applying a new coating, further comprising the step of removing corrosion from the face surface of the wheel by blasting said face surface with a second abrasive media.

3. The method according to claim 2 wherein said first abrasive media is comprised of plastic particles and said second abrasive media is comprised of rigid particles.

4. The method according to claim 3 wherein after removing corrosion with said second abrasive media and before applying a new coating, further comprising the step of removing residual abrasive media from said wheel by air blasting said wheel.

5. The method according to claim 4 wherein after removing said abrasive media by air blasting and before applying said new coating, further comprising the step of masking a valve stem extending through the wheel and masking an area of said tire adjacent said face surface of said wheel with a removable masking means.

6. The method according to claim 5 wherein after applying new coating material, further comprising the step of removing the masking means from said valve stem and said tire area.

7. The method according to claim 6 wherein before reinstalling the wheel weights, further comprising the step of heating said wheel with heating means whereby said new coating material is cured.

8. The method according to claim 6 wherein the step of applying said new coating material comprises applying a first layer of pigmented coating material to said face surface of said wheel and thereafter applying a second layer of a second transparent coating material on top of said first layer.

9. The method according to claim 8 and further comprising the step of heating said wheel after application of one of said first or second coating material layers.

10. The method according to claim 9 wherein before the step of removing said coating from the wheel, further comprising the step of removing water from the wheel with drying means.

11. The method according to claim 9 wherein said first abrasive media is comprised of plastic bead material having a particle size of 30 to 40 mesh.

12. The method according to claim 11 wherein said second abrasive media is comprised of glass bead material having a particle size 70 to 100 mesh.

13. The method according to claim 11 wherein during said step of removing said coating, said wheel is rotated about its central axis on rotating means in supporting relation of said tire.

14. The method according to claim 12 wherein said second coating layer is comprised of a polyurethane material.

15. The method according to claim 14 wherein said heating means for curing said coating layers comprises at least one halogen light.

16. The method according to claim 15 wherein said masking means includes a tube sized in close fitting, slide on relation of said valve stem.

17. The method according to claim 1 wherein said wheel weights are reinstailed before said new coating material is fully cured.

18. A method for refinishing vehicle wheels with the tires attached thereto, comprising the steps of:

removing an existing coating from a decorative exposed face surface of a wheel having a tire mounted thereon in inflated condition, said face surface extending adjacent an exposed tire surface, by blasting said face surface with a first abrasive media comprised of plastic particles;

removing corrosion from said face surface by blasting corroded areas of said face surface with a second abrasive media comprised of rigid particles; and applying a new layer of coating material to said face surface of said wheel.

19. The method according to claim 18 wherein after removing corrosion further comprising the step of blasting said wheel with an air blast to remove residual media prior to applying said new layer coating material.

20. The method according to claim 19 wherein the step of applying said new layer of coating material comprises applying at least one layer of transparent material to said face surface.

* * * * *